US008230561B2

(12) United States Patent
Courchesne

(10) Patent No.: US 8,230,561 B2
(45) Date of Patent: Jul. 31, 2012

(54) APPARATUS FOR LOWERING A CINERARY URN

(76) Inventor: André Courchesne, Val-des-Monts (CA)

( * ) Notice: Subject to any disclaimer, the term of this patent is extended or adjusted under 35 U.S.C. 154(b) by 232 days.

(21) Appl. No.: 12/420,127

(22) Filed: Apr. 8, 2009

(65) Prior Publication Data

US 2009/0260204 A1 Oct. 22, 2009

Related U.S. Application Data

(60) Provisional application No. 61/046,071, filed on Apr. 18, 2008.

(51) Int. Cl.
*A61G 19/00* (2006.01)

(52) U.S. Cl. ..... 27/32; 211/85.27; 254/264

(58) Field of Classification Search ..... 27/26, 27, 27/32–34, 1; 254/264, 362; 187/256; 414/592; 211/85.27
See application file for complete search history.

(56) References Cited

U.S. PATENT DOCUMENTS 1,868,796 A * 7/1932 Harder et al. ..... 27/32
2,218,286 A * 10/1940 Lampe ..... 193/42
2,249,687 A * 7/1941 Eshleman ..... 27/32
6,393,679 B1 * 5/2002 Ascheman ..... 27/32
2004/0197181 A1 * 10/2004 Clark ..... 414/729

FOREIGN PATENT DOCUMENTS

CA 2069277 1/1996

OTHER PUBLICATIONS

Internet website: http://www.hollandsupplyinc.com/loweringdevices.htm Holland Supply, Inc. of Holland, Michigan.

* cited by examiner

*Primary Examiner* — William L. Miller
(74) *Attorney, Agent, or Firm* — Buckingham, Doolittle & Burroughs, LLP

(57) ABSTRACT

An apparatus for lowering an urn comprises a frame, a substantially horizontal platform for supporting the urn, and a lowering mechanism mounted to the frame that is releasably connected to the platform. The lowering mechanism automatically releases the platform when the platform is in the bottom position. To releasably connect the lowering mechanism to the frame, four hangers may be used to releasably connect the platform to respective suspension straps. Each hanger may comprise a square body for insertion through a corresponding square hole in the platform. Each hanger may have a pivoting arm that pivots into a substantially horizontal posture to support the platform from underneath, the pivoting arm of the hanger comprising a counterweight to cause the pivoting arm to return to a substantially vertical posture when legs underneath the platform reach the bottom position.

11 Claims, 16 Drawing Sheets

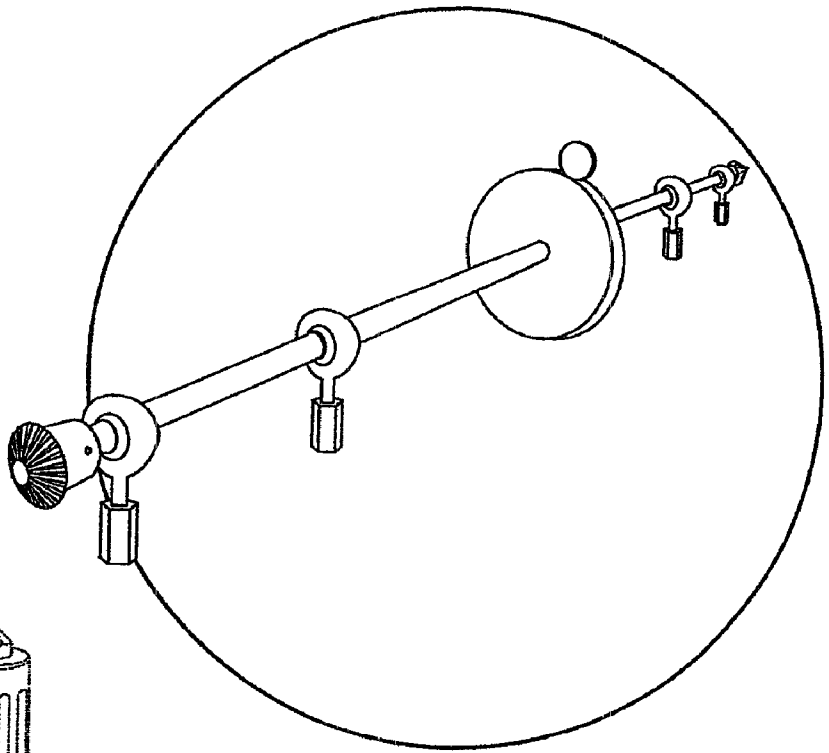
FIG. 9
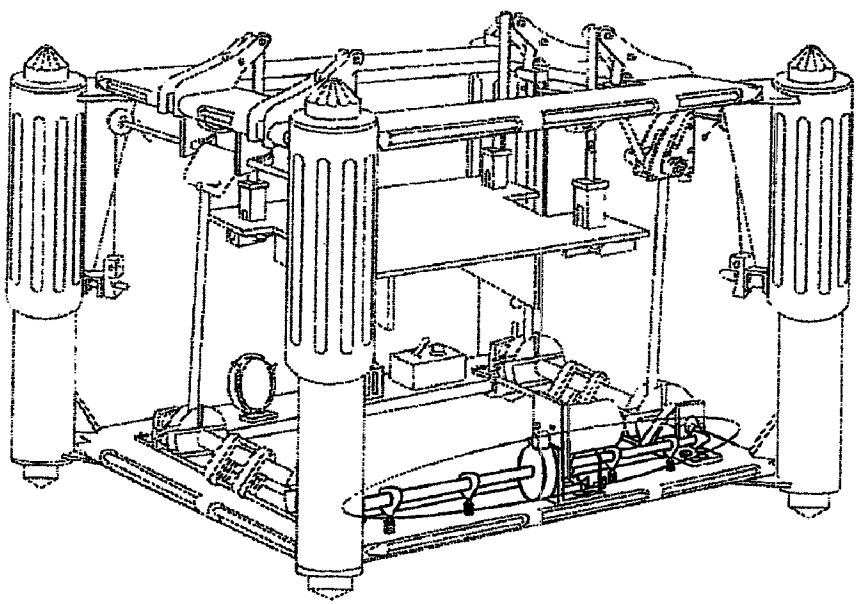

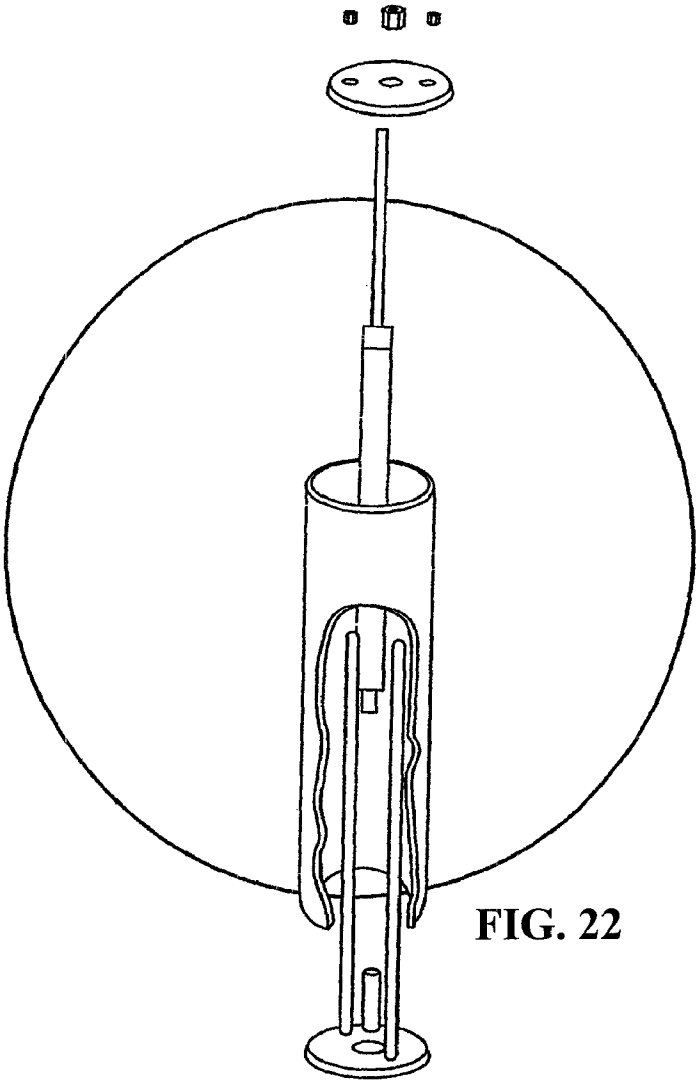
FIG. 22
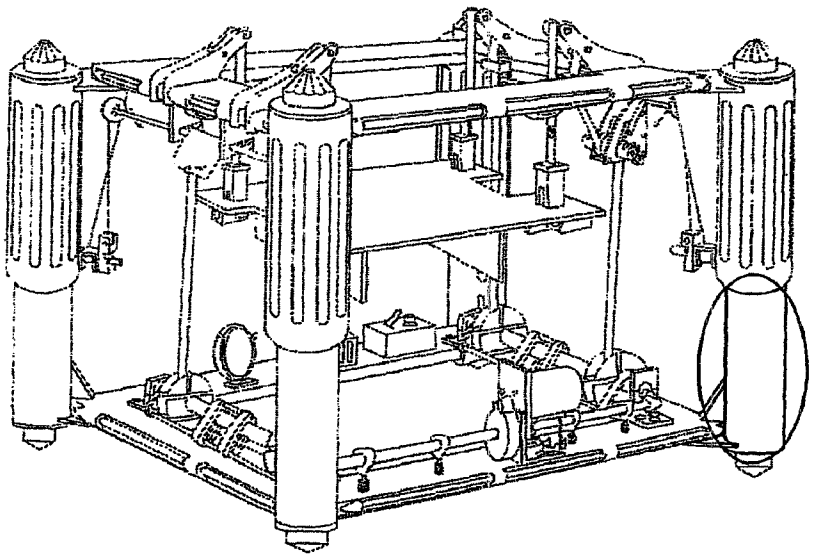

APPARATUS FOR LOWERING A CINERARY URN

CROSS-REFERENCE TO RELATED APPLICATIONS

This application claims priority under 35 USC 119(e) from U.S. Provisional Patent Application 61/046,071 filed Apr. 18, 2008.

TECHNICAL FIELD

The present invention relates generally to burial equipment and, in particular, to lowering devices for interring a cinerary urn.

BACKGROUND

Cinerary urns, also known as cremation urns, funeral urns or burial urns, are used to hold the ashes or cremation remains of a dead person or dead animal. The cinerary urn (hereinafter simply the "urn") may then be buried at a gravesite, placed in a mausoleum or columbarium, or kept at the home of the next of kin, according to local custom and religious practice.

Traditionally, burial of an urn is accomplished by manually lowering the urn into the ground or by placing the urn in a bag and then lowering the urn using a cord attached to the bag in other cases, casket-lowering equipment is sometimes used to lower the urn, although this is generally awkward.

Applicant is aware of one prior-art urn-lowering device. This device is sold by Holland Supply Inc (of Holland, Mich., United States of America), and is shown at http://www.hollandsupplyinc.com/lowering_devices.htm. This prior-art urn-lowering device is simply a modified version of the casket-lowering device. This device has a fixed outer frame and a movable interior frame that is lowered using a manual crank. The main problem with this prior-art urn-lowering device is that there is nothing to release the urn once it has been lowered into the hole in the ground. After the ceremony, the urn has to be raised back up, the urn-lowering device removed, and then the urn is placed in the hole by hand. This is clearly an unsatisfactory technique.

An improved urn-lowering apparatus that is able to release the urn when it has been lowered into the ground thus remains highly desirable. Such an improvement would provide a far more dignified burial for the family and friends of the deceased.

SUMMARY OF THE INVENTION

In accordance with a main aspect of the present invention, an apparatus for lowering an urn comprises a frame, a substantially horizontal platform for supporting the urn, and a lowering mechanism mounted to the frame and releasably connected to the platform for lowering the platform from a top position to a bottom position and for automatically releasing the platform when the platform is in the bottom position.

In order to releasably connect the lowering mechanism to the frame, this apparatus may employ four hangers. These hangers releasably connect the platform to respective suspension straps. Each hanger may comprise a square body for insertion through a corresponding square hole in the platform Each hanger may further comprise a pivoting arm that can be pivoted into a substantially horizontal posture to support the platform from underneath, the pivoting arm of the hanger comprising a counterweight to cause the pivoting arm to return to a substantially vertical posture when legs underneath the platform reach the bottom position, thus removing the weight of the platform from the pivoting arm of the hanger to thereby enable rotation of the hanger into the substantially vertical posture that permits the platform to be released by pulling the hangers upwardly through the respective holes in the platform.

In accordance with another aspect of the present invention, a disposable H-shaped platform for use with an apparatus for lowering an urn comprises four square holes for receiving respective hangers, the holes being disposed in corner extensions of the platform, each pair of corner extensions defining a rectangular cut-out region to enable the platform to be displaced vertically without interfering with the apparatus, and a pair of legs having a depth greater than a pivoting arm of the hanger. These disposable platforms can be made of a biodegradable material, such as MDF, and are meant to be buried with the urn.

In accordance with yet another aspect of the present invention, a method of lowering a cinerary urn involves placing the urn on a substantially horizontal platform suspended by a frame of an apparatus, operating a lowering mechanism mounted to the frame of the apparatus to lower the platform and the urn from a top position to a bottom position, and automatically releasing the platform when the platform is in the bottom position.

BRIEF DESCRIPTION OF THE DRAWINGS

Further features and advantages of the present technology will become apparent from the following detailed description, taken in combination with the appended drawings, in which:

FIG. 9 is a perspective view of the gear shaft and associated bevel and spur gears;

FIG. 22 is an exploded view of a bottom leg;

It will be noted that throughout the appended drawings, like features are identified by like reference numerals.

DETAILED DESCRIPTION OF EMBODIMENTS

Embodiments of the present invention will now be described in detail with reference to the exemplary apparatus depicted in the attached drawings.

Figure 1:
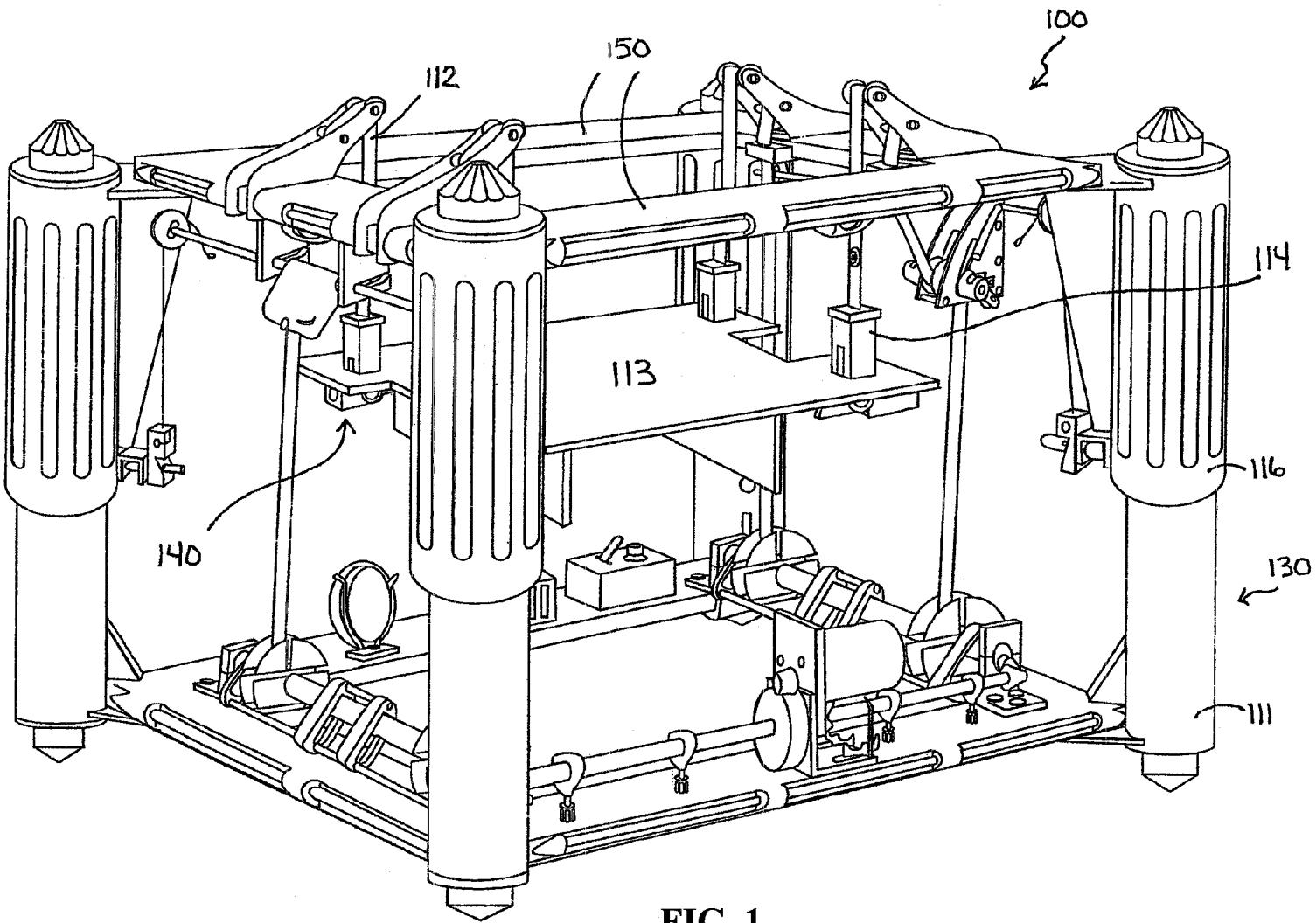
FIG. 1 is an isometric view of an apparatus for lowering an urn in accordance with one embodiment of the present invention.
Figures 1A, 2, 2A:
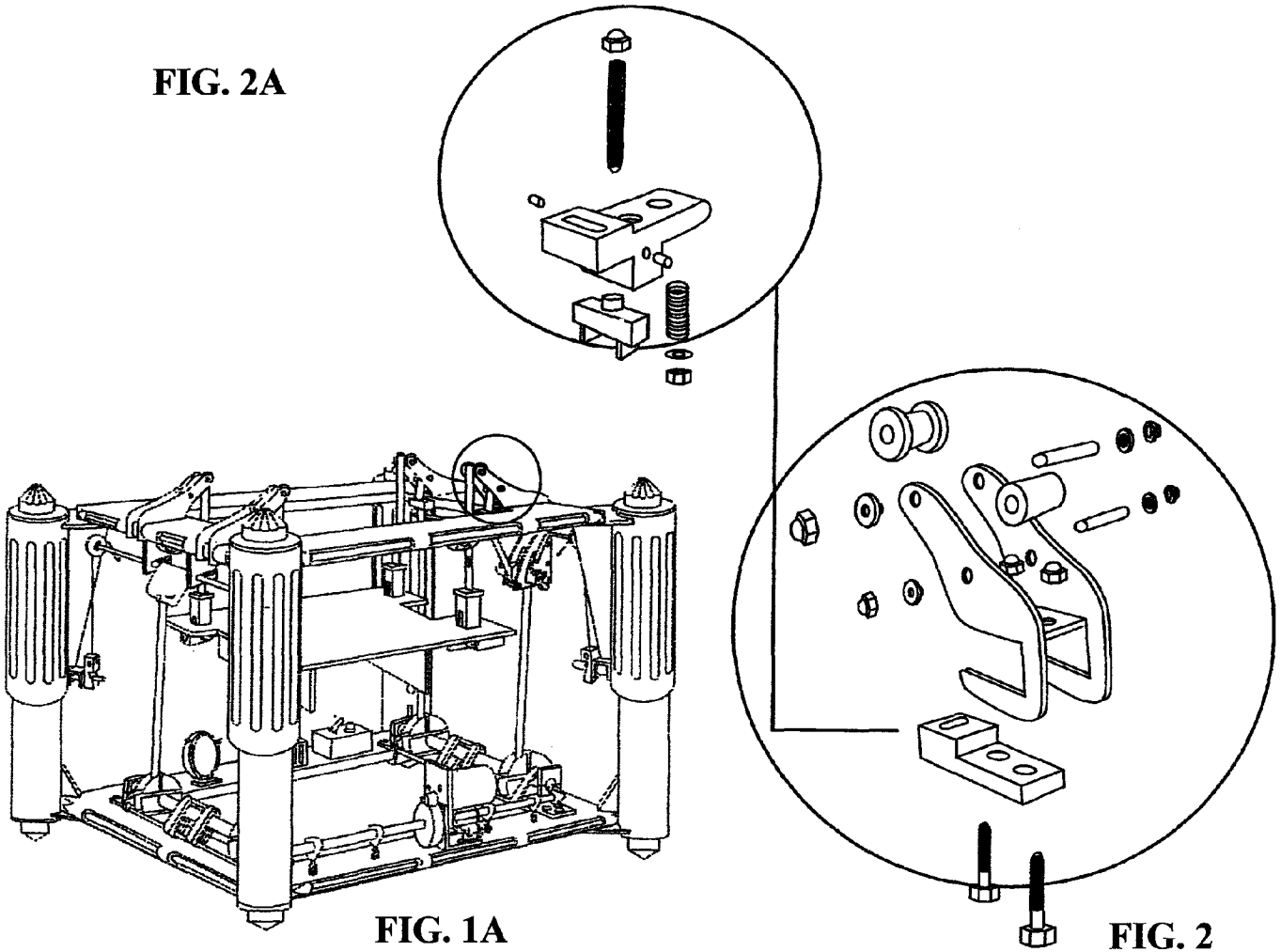
FIG. 1A is the same isometric view of the apparatus as was presented in FIG. 1.
FIG. 2 is an exploded view of a tow arm.
FIG. 2A is an exploded view of a kill switch.

FIG. 1 is an isometric view of an apparatus for lowering an urn (or other such device or object) in accordance with one embodiment of the present invention. The apparatus is generally designated by reference numeral 100. The apparatus 100 comprises a frame 130 (that includes, as also shown in FIG. 1A, both an upper frame 116 and a bottom frame 111). The apparatus 100 further comprises a substantially horizontal platform (e.g. a board 113 shown in FIGS. 1 and 1A) for supporting the urn. It is noted that the urn itself is not shown in the drawings. For the purposes of this specification, an "urn" is meant to include any form of container that contains or holds cinerary ashes, either of a human or animal, including any sort of box, enclosure, bag, etc. As shown, the apparatus 100 further comprises a lowering mechanism (or "platform elevator") generally designated by numeral 140 mounted to the frame and releasably connected to the platform for (primarily) lowering the platform from a top position to a bottom position and for automatically releasing the platform when the platform has bottomed out, i.e. is down in the bottom position. In the top position, the platform 113 is preferably substantially level with upper horizontal frame members 150. This enables the urn to be fully visible for ceremonial reasons prior to lowering and burial. In the bottom position, if the depth has been properly measured, as will be elaborated below, the platform 113 should be resting on the ground in the grave where the urn is to be buried.

As shown in the embodiment presented in FIGS. 1 and 1A, the lowering mechanism may comprise four hangers 114 for releasably connecting the platform 113 to respective suspension straps 112. A different number of straps may be possible in other embodiments. In the particular embodiment shown in FIG. 1A, the suspension straps (e.g. Nylon straps) are wrapped over respective tow arms 118 and reeled by respective reels 125. Details of the tow arms are depicted in FIG. 2 and FIG. 2A. In the particular embodiment shown in FIG. 1A, each pair of reels 125 on each side of the apparatus are driven by reel shafts 128 that are, in turn, driven by an orthogonally disposed gear shaft 104. As shown in FIG. 1A, an electric motor 107 (which is mounted to the frame by motor mount 106) can be used to drive the gear shaft and, in turn, the two reel shafts. Operation of the motor 107 may be controlled by control box 103 and remote control unit 123, as depicted in these figures, or by some other equivalent means. These and other components shown in FIG. 1A will be described in greater detail below.

Figures 5, 5A:
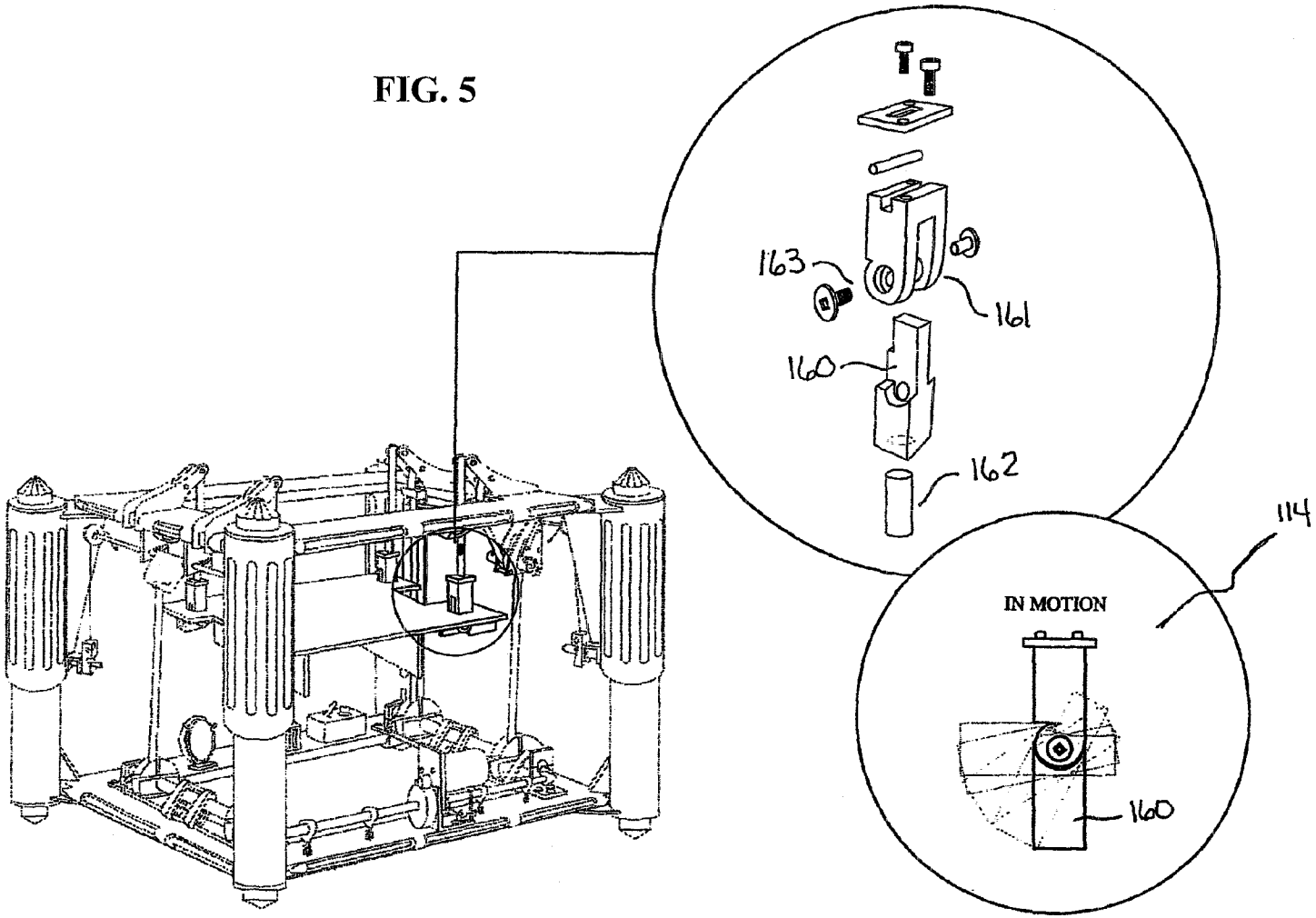
FIG. 5 is an exploded view of one of the hangers.
FIG. 5A is a side view of the range of motion of each hanger.

As further shown by way of example in FIGS. 1, 1A and 5, each hanger 114 comprises a square body for insertion through a corresponding square hole in the platform. As will be appreciated, the hanger body and respective holes may be designed with other shapes. Each hanger further comprises a pivoting arm 160 that can be pivoted into a substantially horizontal posture to support the platform from underneath, the pivoting arm of the hanger comprising a counterweight to cause the pivoting arm to return to a substantially vertical posture when legs underneath the platform reach the bottom position, thus removing the weight of the platform from the pivoting arm of the hanger to thereby enable rotation of the hanger into the substantially vertical posture that permits the platform to be released by pulling the hangers upwardly through the respective holes in the platform. In other words, the hanger's pivoting arm 160 is rotated into the horizontal posture to support the platform. The weight of the platform acting on both sides of the pivoting arm is sufficient to hold the hangers in that horizontal posture. Only when the weight is removed (by bottoming out the platform) does the pivoting arm fall back into the vertical posture by virtue of gravity acting on the counterweight. When the hangers are vertical, they can be lifted out of their respective holes to thus release the platform. The platform can thus be buried with the urn.

FIG. 5 shows all relevant construction details of the hanger 114 in accordance with one embodiment while FIG. 5A depicts the range of pivoting motion for the pivoting arm 160 of the hanger. As shown in FIG. 5 and FIG. 5A, the pivoting arm 160 pivots about a pin (or bolt 163) that is held rotatably within a bracket 161. A dowel 162 (e.g. made of brass or other suitable material) is inserted into the pivoting arm (e.g. made of aluminum or other suitable material) and thus serves as a counterweight to pivot the arm automatically when the platform (board) bottoms out.

Figure 7:
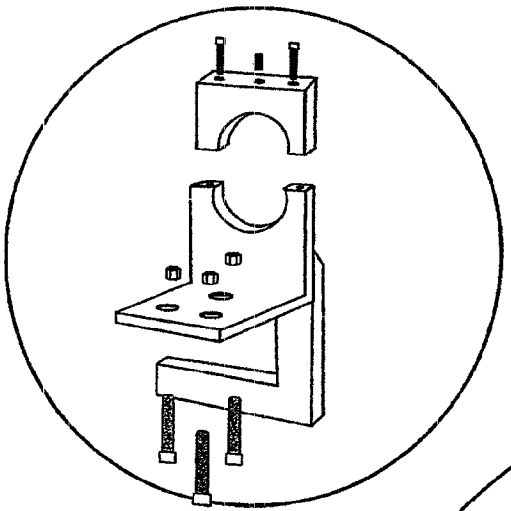
FIG. 7 is an exploded view of the bearing mount.
Figure 8:
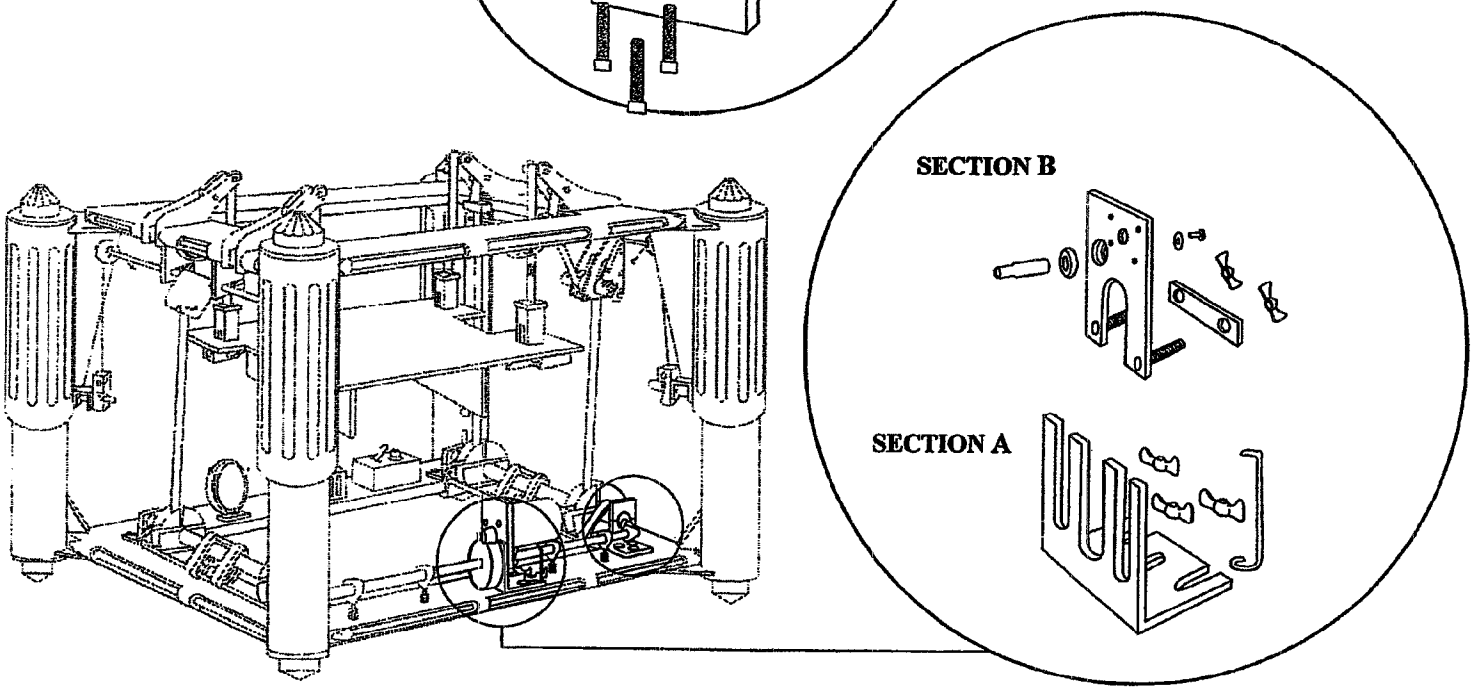
FIG. 8 is an exploded view of the motor mount.
Figure 10:
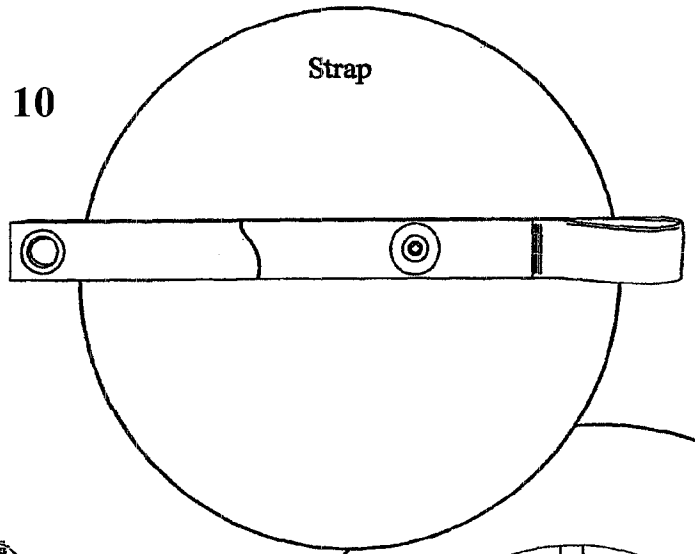
FIG. 10 is a side view of the nylon strap.
Figure 11:
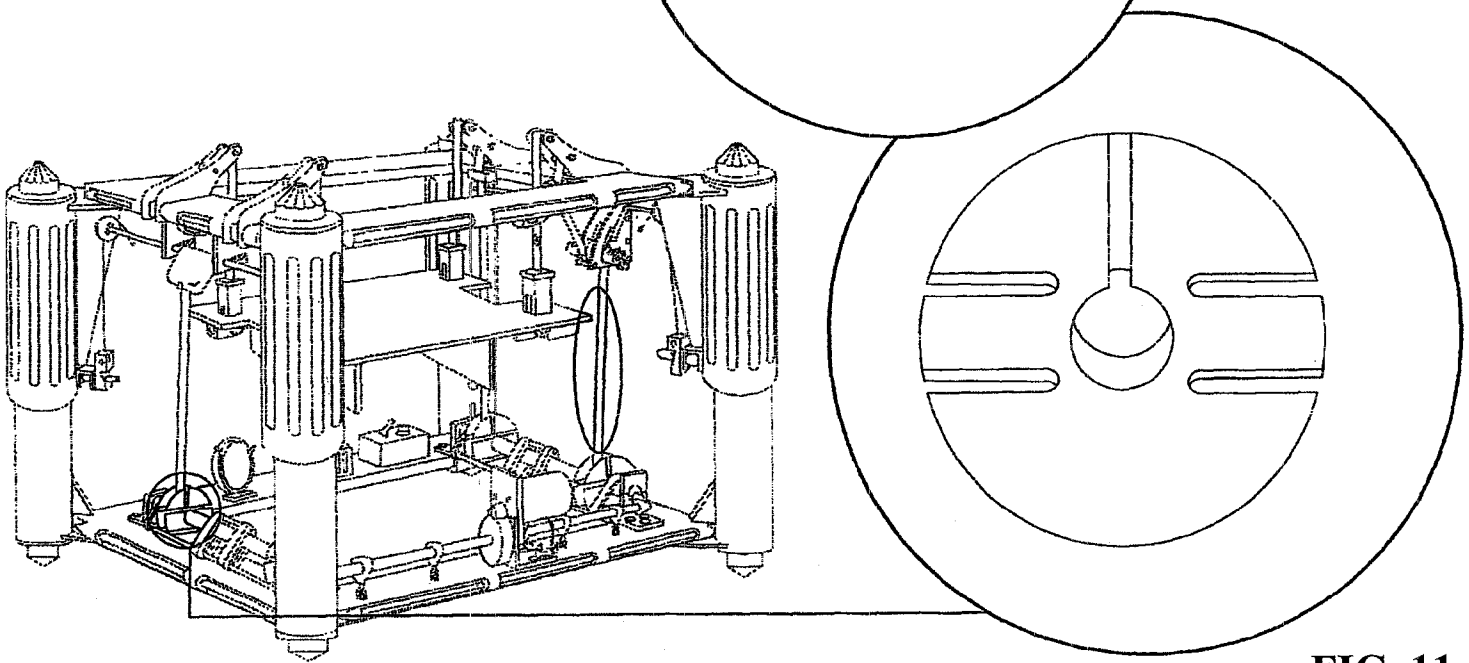
FIG. 11 is a side view of the reel.
Figures 12, 13, 13A:
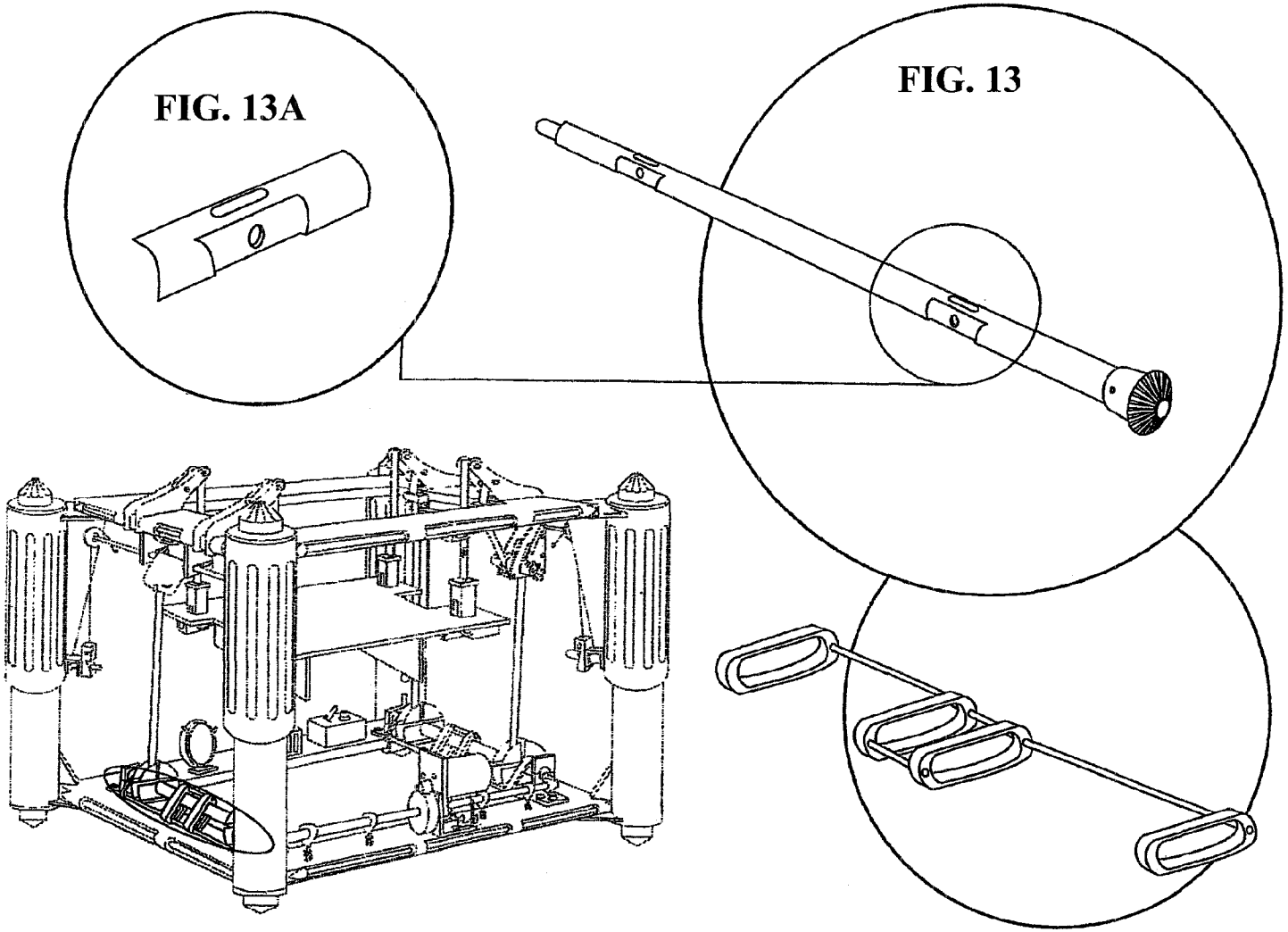
FIG. 12 is an isometric view of the level bar.
FIG. 13 is a perspective view of the reel shaft.
FIG. 13A is an enlarged view of a portion of the reel shaft containing the strap slot and bore for the set screw.

In one embodiment, the lowering mechanism comprises a reel 125 driven by an electric motor 107 for reeling the suspension straps 112 (shown in FIG. 10) around each respective reel to thereby lower the platform. The reels are depicted in FIG. 11. The reels are driven by respective reel shafts such as the one shown by way of example in FIG. 13. In the particular configuration depicted in the figures, the apparatus has two reel shafts. FIG. 13A is an enlarged view of an exemplary strap slot and bore for a set screw for securing the straps. Each of the reel shafts rotates inside parallel slots of the level bar shown in FIG. 12. The function of this level bar will be described in greater detail below Each reel shaft rotates on bearings (e.g. ball bearings) or equivalent that are mounted within bearing mounts (see FIG. 7) and is driven by a gear shaft shown in FIG. 9. The gear shaft shown in FIG. 9 has bevel gears at each extremity as well as rod end bearings for providing support at the desired level. The gear shaft is driven via spur gears (shown in FIG. 9) by an electric motor mounted via a motor mount (bracket assembly) shown in FIG. 8. The electric motor may be a 12V DC motor, for example, although it could also be a motor with a higher DC voltage or even an AC motor (with appropriate modifications). Based on the speed and torque rating of this electric motor, the spur gear ratio may need to be modified to achieve the desired range of lowering/raising speeds and/or to handle a desired range of payloads (e.g. not only light wood urns but also heavier ceramic or marble urns).

Figures 14, 15, 15A:
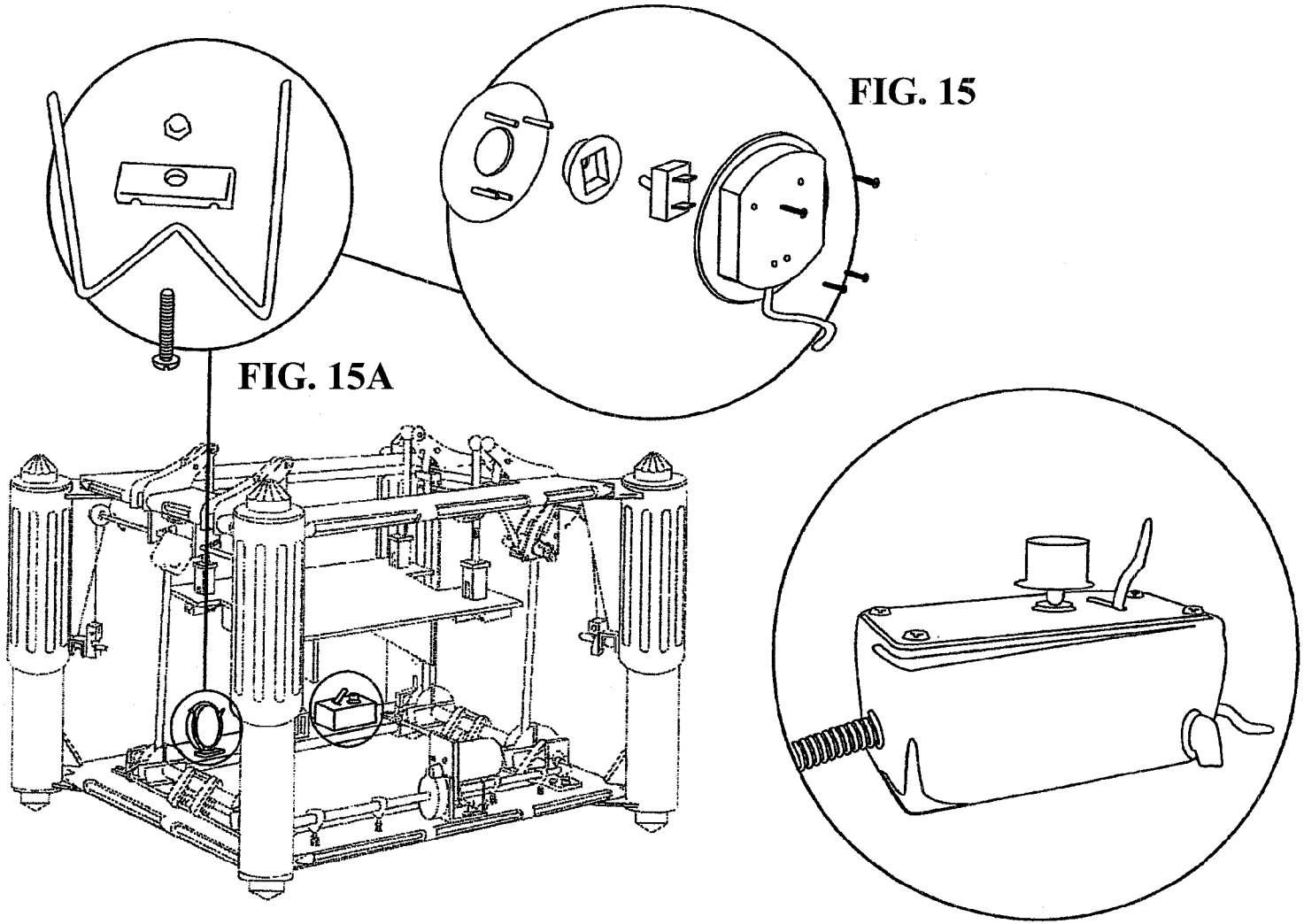
FIG. 14 is a perspective view of a control box.
FIG. 15 is an exploded view of a remote control unit.
FIG. 15A is an exploded view of mounting equipment for mounting the remote control unit to a base of the frame.

The electric motor is controlled by a control box (such as the one depicted by way of example in FIG. 14). This control box, which may be made of plastic or other suitable material, is secured to the bottom frame. The control box has a speed control knob, a forward/reverse (up/down) lever to lower (descend) or raise (elevate) the platform. As shown, the control bottom has wires for wiring the box to a battery (or other power supply), wires leading to a remote control unit shown in FIG. 15, and wires leading to a kill switch (shut-off switch)

connected to a tow arm on an upper portion of the frame. FIG. 15 depicts details of the remote control unit while FIG. 15A shows example hook-up equipment used to mount the remote control unit on the bottom frame.

Figure 17:
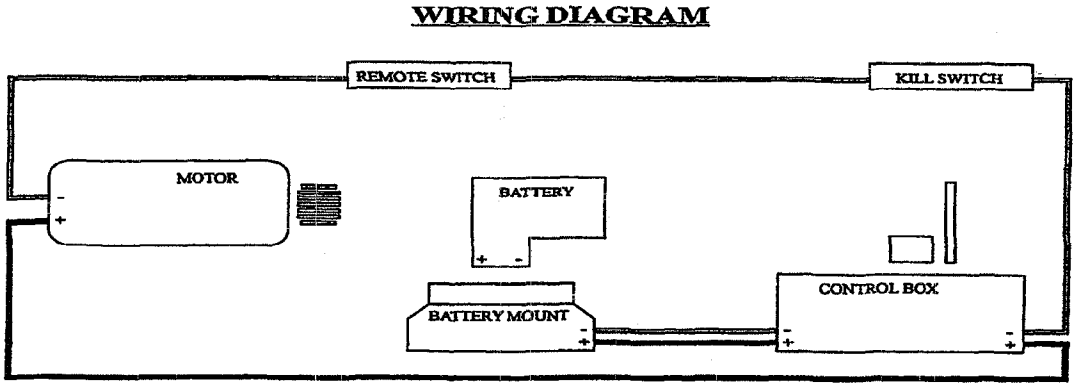
FIG. 17 is a wiring diagram.
Figure 16:
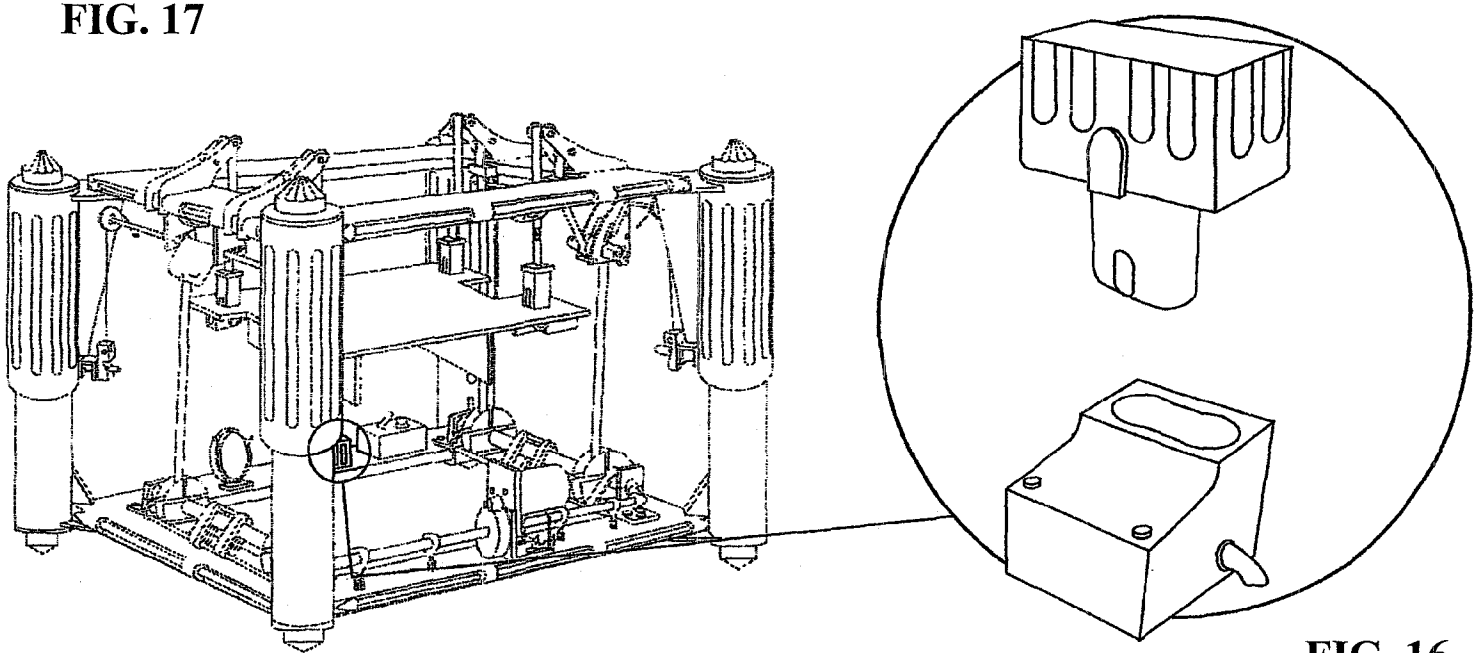
FIG. 16 is a perspective view of a battery, charger and battery mount.

Beside the control box on the bottom frame is a battery mount for receiving a battery, for example a 12V battery, that supplies power for driving the electric motor. The apparatus can be modified to utilize alternative power supplies or sources. The battery and battery mount are shown in FIG. 16 by way of example. FIG. 17 is an exemplary wiring diagram that shows how the various electrical components of this apparatus may be wired.

In one embodiment, the lowering mechanism comprises a locking mechanism that, during setup of the apparatus, is set for a desired depth corresponding to the bottom position so that the locking mechanism releases the platform when the platform reaches the bottom position and furthermore causes the reel to rotate in an opposite direction to lift the hangers through the respective holes of the platform. In one particular embodiment, this locking mechanism includes a level bar 126 such as the one shown in FIG. 1A and again in FIG. 12 As shown in the figures, this level bar is mounted through the reel shaft. During setup, once the depth of the hole has been determined, the level bar is then inserted into the parallel slots formed in the reels (see FIG. 11) at both ends. The level bar thus acts has a depth finder during rotation to release the board at the desired depth.

Figure 3:
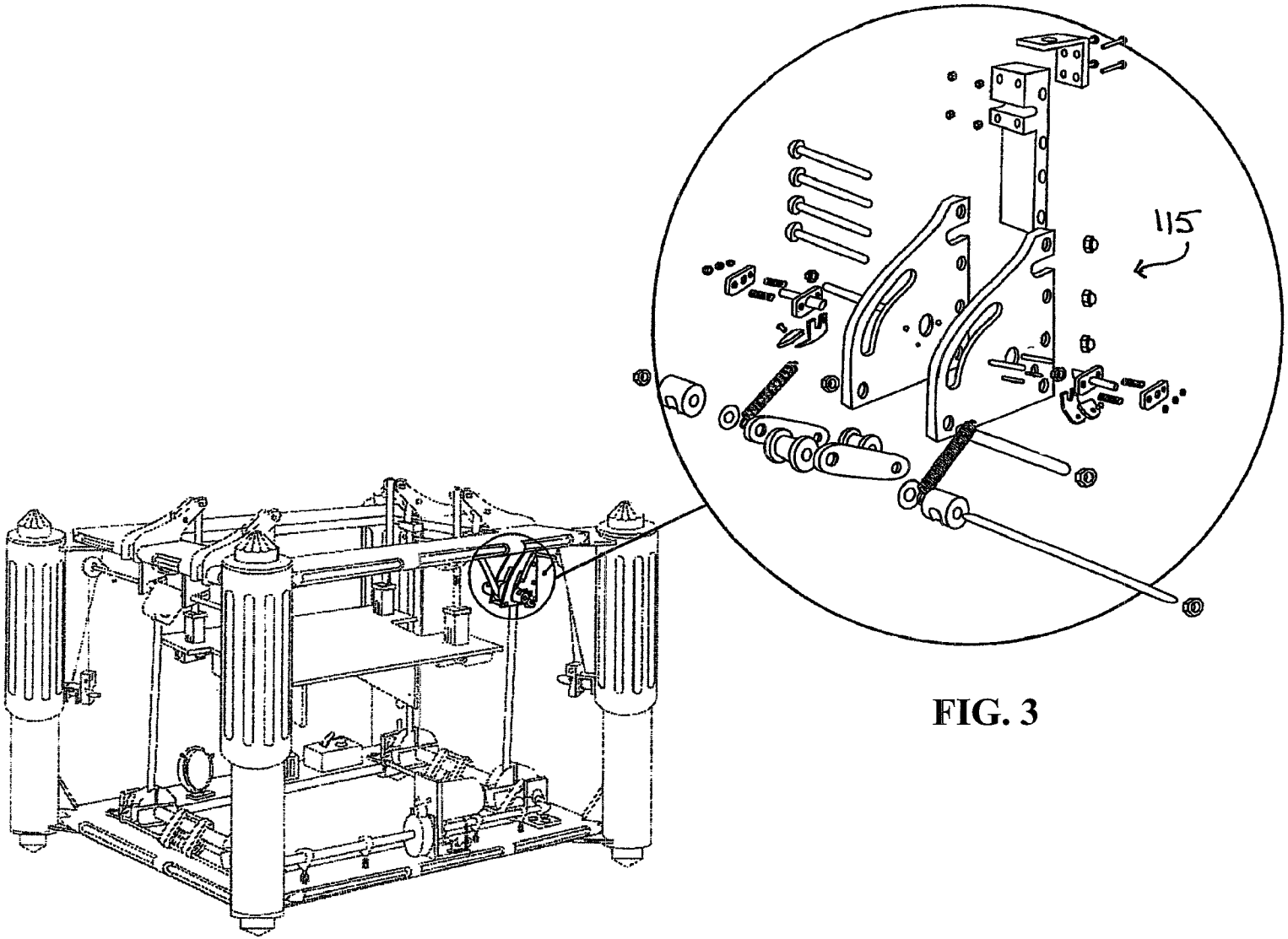
FIG. 3 is an exploded view of a tension releaser.

In one embodiment, the lowering mechanism comprises a tension releaser 115 mounted to the frame for releasing tension on the strap 112. An example of this tension releaser mechanism is shown in detail in FIG. 3. Once a kill switch (or shut-off switch) has been activated, the strap is still under tension. The tension releaser 115 thus enables the user of the apparatus to release the tension on the strap. As shown in FIG. 1A and FIG. 3, the tension releaser includes a bracket for mounting to the frame in alignment with one of the tow arms.

Figure 24:
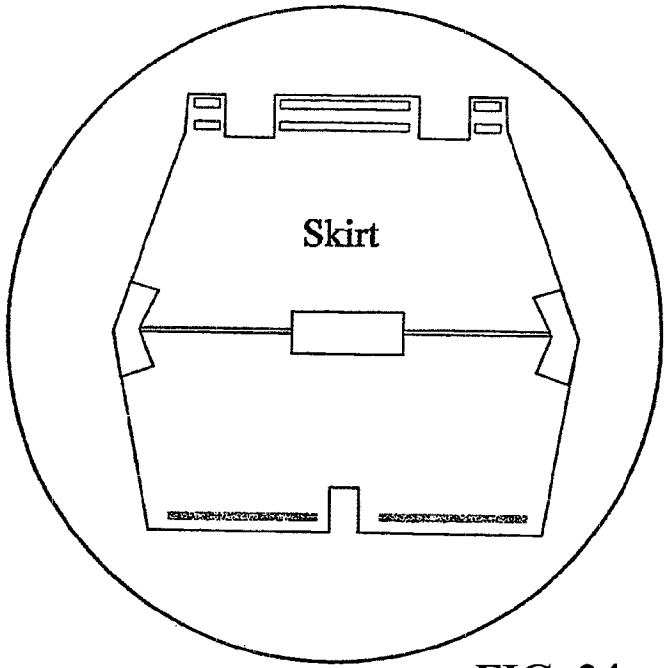
FIG. 24 is a perspective view of a skirt that is attached to the skirt rods of the apparatus.
Figure 23:
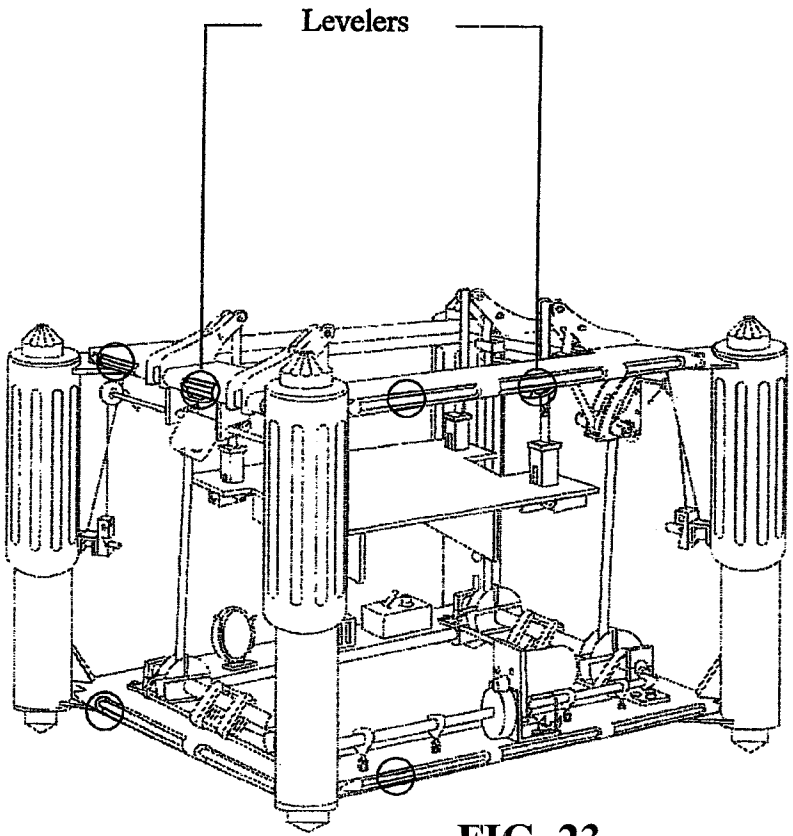
FIG. 23 is an isometric view of the apparatus showing the levellers and skirt rods.

In one embodiment, as shown in FIG. 1A, the frame may comprise a plurality of skirt rods 127 for holding a skirt that conceals mechanisms internal to the apparatus. FIG. 23 is an isometric view of the apparatus showing liquid-bubble levellers 119 and skirt rods 127. These levellers can be embedded within horizontal members of the frame, as shown, for leveling the frame FIG. 24 is a perspective view of a skirt that can be attached to the skirt rods of the apparatus. This skirt can be attached using Velcro™ or other suitable means (e.g. strings, ties, straps, buckles, clips, buttons, etc.). This skirt can be made of vinyl or other suitable weather-resistant material. As shown in FIG. 24, the skirt may be buttressed with a stainless steel rod to give the skirt the desired shape and form when installed on the frame of the apparatus and to minimize the impact of wind on the shape of the skirt. Not only does the skirt hide the hardware components inside the frame, but the skirt provides an exterior surface upon which a logo, symbol, word, trademark may be inscribed.

In one embodiment, the frame comprises four substantially upright legs, each substantially upright leg having a hydraulic cylinder for vertically displacing an upper leg relative to a lower leg. As shown by way of example in FIG. 1A, the bottom leg and upper leg effectively form part of the bottom frame 111 and upper frame 116, respectively. Details of the legs will be described below with reference to FIGS. 19 and 22 which show example designs for these components.

Figures 4, 4A:
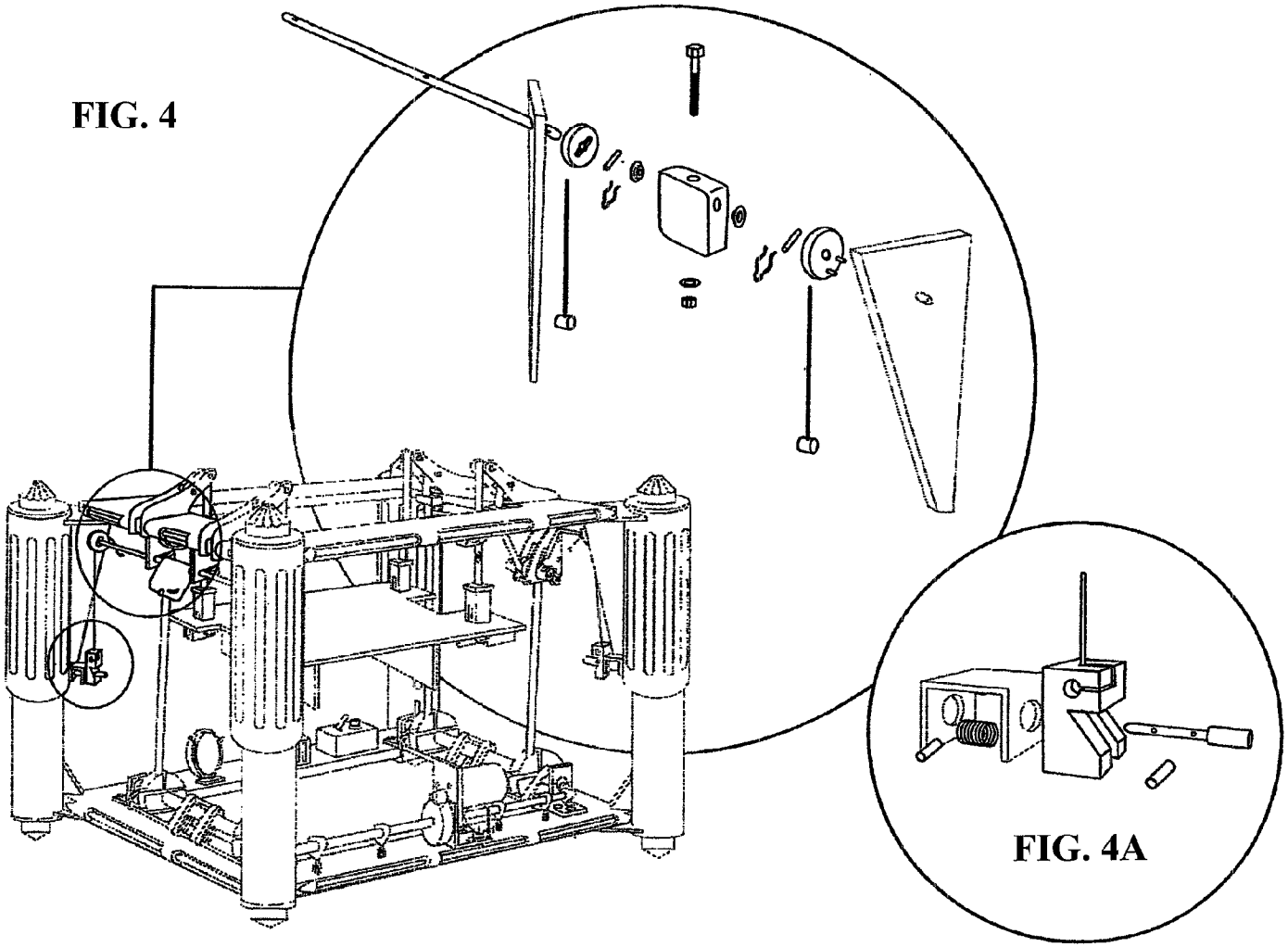
FIG. 4 is an exploded view of a level hole mechanism.
FIG. 4A is an exploded view of the pin (trigger) mechanism.

In one embodiment, the frame comprises a pair of cable-actuated frame-collapsing mechanisms, wherein each mechanism has a pull rod for actuating a cable that disengages a trigger pin from a hole in the substantially upright leg. One of these mechanisms (also referred to herein as a "level holes mechanism") is illustrated in FIG. 4. In operation, the user pulls the rods on each side of the frame simultaneously upwardly to actuate the cable to disengage the pin (trigger) from a hole. The frame can be collapsed to a storage position and unfolded or expanded to an operational position. Each leg may include a hydraulic cylinder to facilitate the unfolding of the frame. FIG. 4A is an exploded view of the pin (trigger) mechanism for causing the pin (trigger) to engage and disengage with a respective hole in the leg.

Figures 6, 6A:
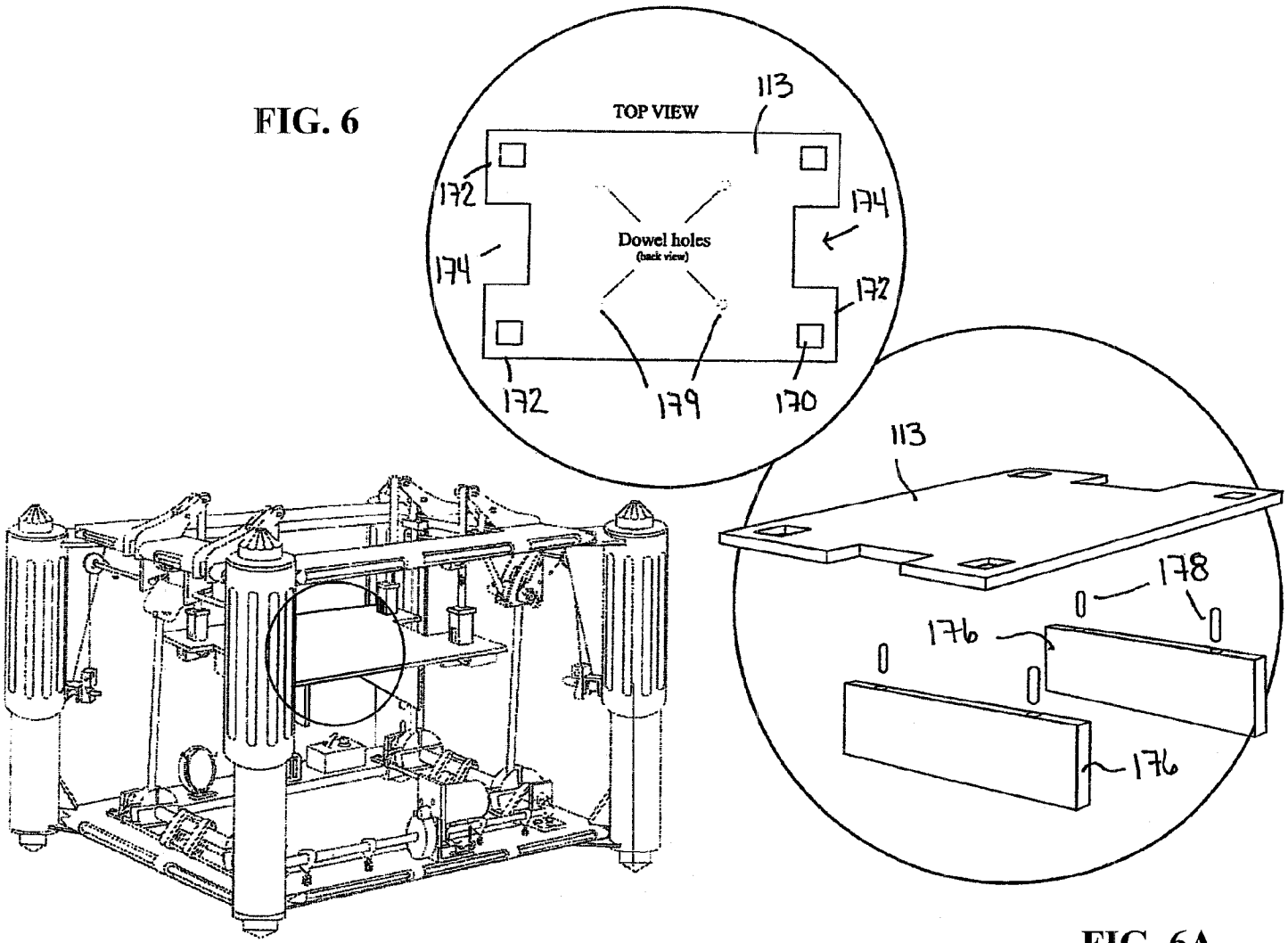
FIG. 6 is a top plan view of the platform (board)
FIG. 6A is an exploded view of the platform (board)

Another aspect of this invention is a disposable H-shaped platform for use with an apparatus for lowering an urn. This disposable platform comprises four square holes 170 for receiving respective hangers, the holes being disposed in corner extensions 172 of the platform. Each pair of corner extensions defines a rectangular cut-out region 174 to enable the platform to be displaced vertically without interfering with the apparatus. The platform also comprises a pair of legs 176 having a depth D greater than a pivoting arm of the hanger. FIG. 6 is a top plan view of a preferred embodiment of this platform (also known as a "board"). FIG. 6A is an exploded view of the platform (board) showing the legs (slats) and wood dowels 178 that are used to connect the legs/slats to the board via predrilled dowel holes 179 shown in FIG. 6. The platform/board can be made of MDF or another suitable biodegradable material (since the platform is intended to be buried with the urn).

As noted above, further details and features of the frame will now be discussed with reference to FIGS. 18 to 22, which are also presented by way of example.

Figures 18, 19, 19A:
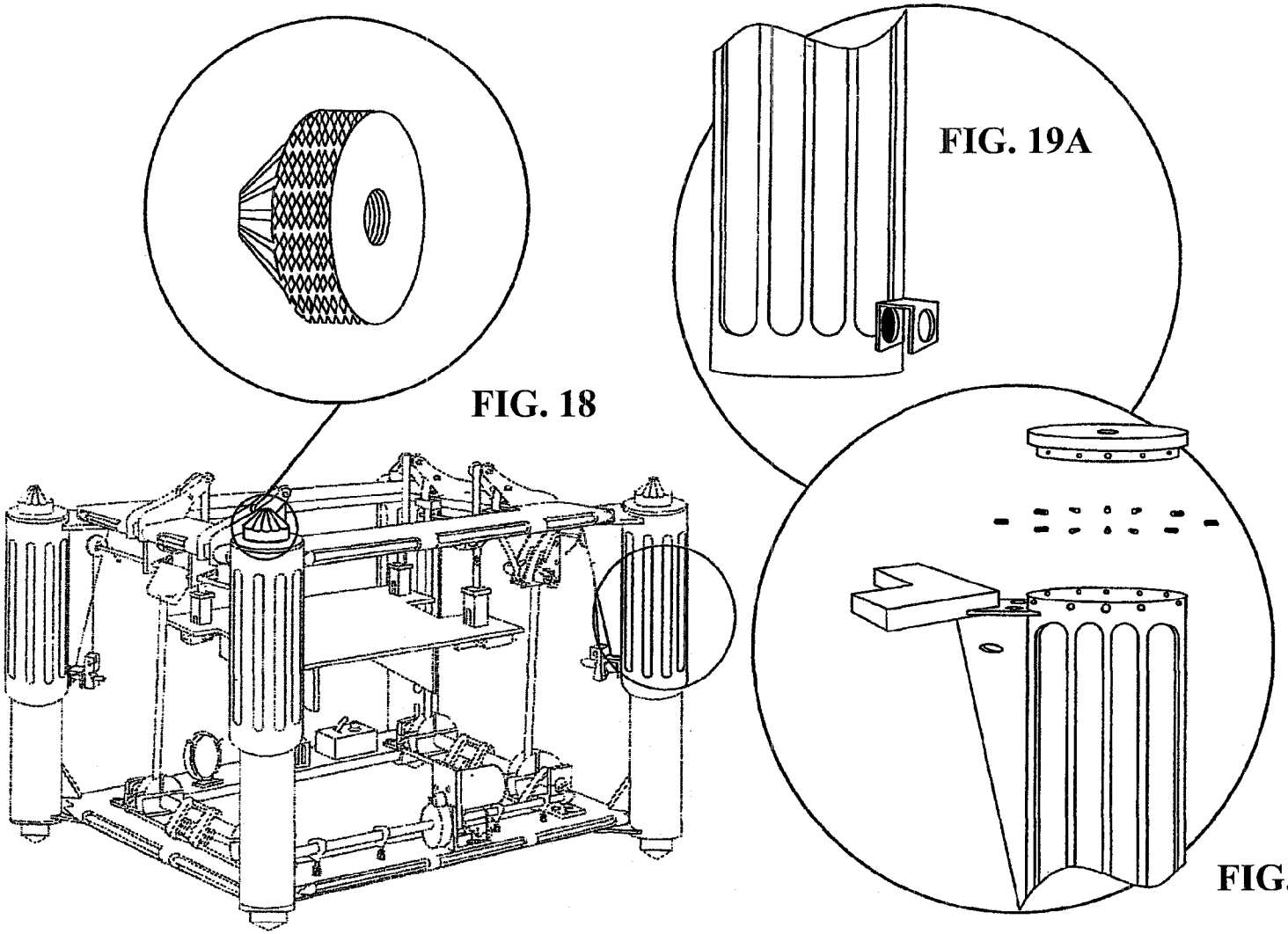
FIG. 18 is a bottom view of an end cap.
FIG. 19 is an exploded view of an upper leg.
FIG. 19A is an enlarged perspective view of the trigger pin support on the upper leg.

FIG. 18 is a bottom view of an optional end cap used as a decorative component on the top of each leg. This decorative end cap can be internally threaded (tapped) to enable the end cap to be screwed onto the upper tip of the hydraulic cylinder that is built into each leg. An optional knurling on the outer surface of the end cap can be provided for better gripping by a user, especially in wet weather.

FIG. 19 is an exploded view of an upper leg. Each of these legs may be cylindrical and hollow (i.e. tubular) with a welded flange to enhance overall structural rigidity and for supports rods at each extremity. As shown in FIG. 19, a top cap secured by a plurality of set screws is used to position the hydraulic cylinders (see also FIG. 22).

FIG. 19A is an enlarged perspective view of the trigger pin support on the upper leg. This support has a hole for receiving the trigger pin shown in FIG. 4A.

Figures 20, 20A, 21:
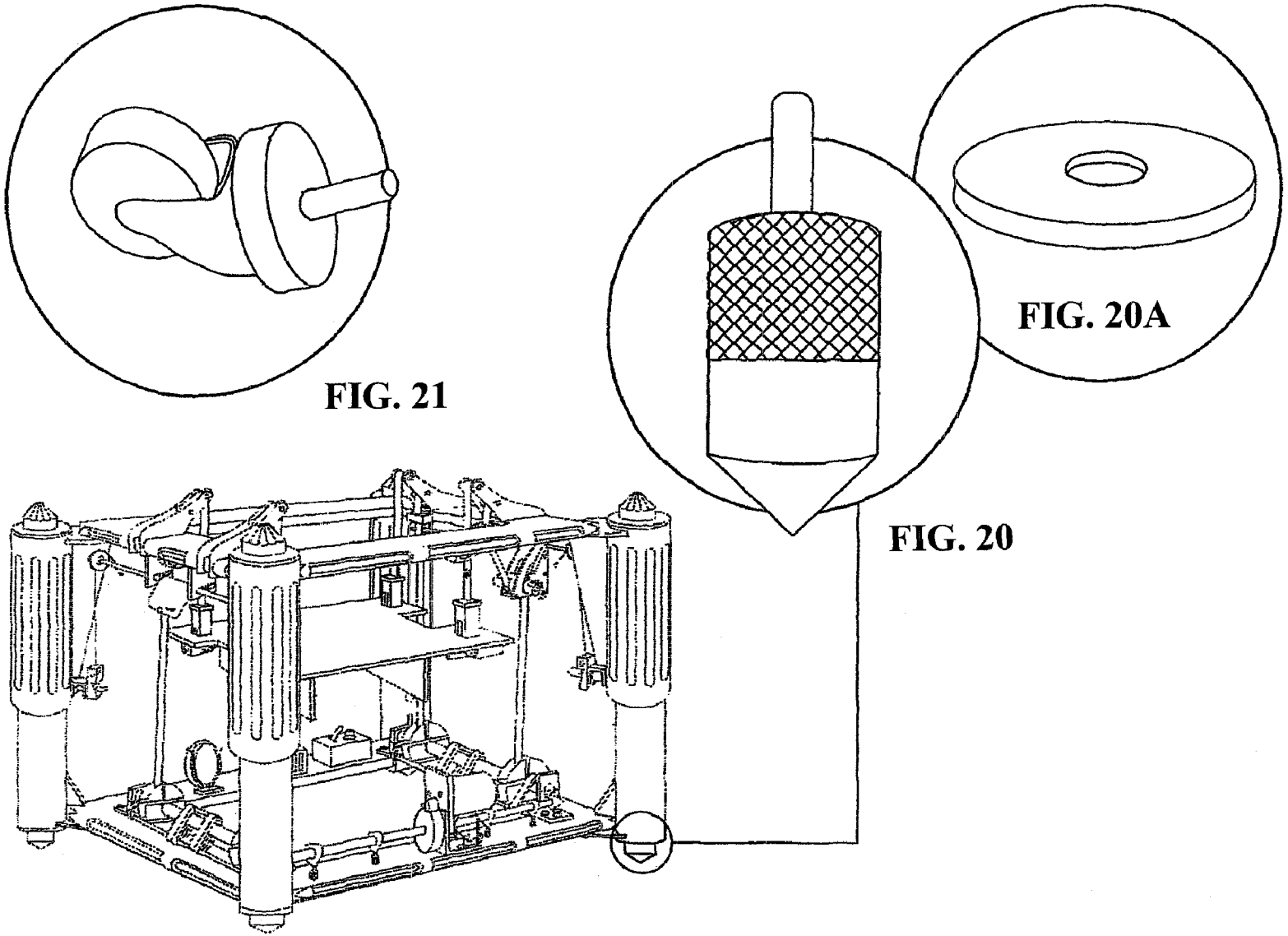
FIG. 20 is an isometric view of a foot peg.
FIG. 20A is an isometric view of an optional plate for resting the apparatus on soft terrain.
FIG. 21 is an isometric view of a caster wheel.

FIG. 20 is an isometric view of an example of a foot peg that may be secured to an underside of each bottom leg. The foot peg has a conical tip facing downwardly to penetrate the ground upon which the apparatus is resting. A knurled outer surface facilitates the task of threading the foot peg into the underside of the bottom leg even if the foot peg gets wet. FIG. 20A is an isometric view of an optional plate for resting the apparatus on soft terrain. In other words, these plates provide greater surface area to reduce the degree to which the apparatus will sink into the ground when the apparatus is used on soft or muddy terrain. The foot pegs can also be replaced with wheels or caster wheels (shown in FIG. 21) for rolling the apparatus over a floor or other flat surface, e.g. for displacing the apparatus indoors. The caster wheel may have a knurled nylon nut or equivalent piece to facilitate the task of screwing the caster wheel into the bottom of each leg.

FIG. 22 is an exploded view of a bottom leg. As shown in FIG. 22, the bottom leg is tubular (i.e. a hollow cylindrical pipe) which contains a hydraulic cylinder for dampening (cushioning) the descent of the upper leg relative to the bottom leg when the frame is collapsed. Likewise, the hydraulic cylinder assists with the raising of the upper leg relative to the bottom leg when the frame of this apparatus is unfolded. The top cap shown in FIG. 22 has a hole for the hydraulic cylinder to move freely whereas the bottom cap has a female coupling into which the foot pegs (or caster wheels) can be threaded.

From the foregoing, it should now be apparent that this novel apparatus makes use of a platform elevation mechanism (that acts primarily as a platform lowering mechanism) for lowering a cinerary urn (or other device) into the ground or other resting spot. The mechanism is designed to automatically release the platform when it bottoms out (i.e. reaches the bottom position of its travel) so that this mechanism can then be retracted or raised back to its original upper position without the platform and urn (which having been disconnected remain in the ground). This apparatus therefore enables one to easily lower an urn in a smooth, controlled and dignified manner. Moreover, since the platform is automatically released, one can easily retract the platform lowering mechanism without having to reach into the interment hole to manually detach the platform, which can be awkward and which may have the effect of detracting from the solemnity of the burial ceremony.

This novel apparatus can be used in an actual burial (interment into a grave) or in a ceremony that involves a symbolic lowering of the urn (in which case the urn is afterwards interred, e.g. interred in a grave or placed above-ground in a niche in a mausoleum).

The apparatus disclosed herein also enables a novel method of lowering a cinerary urn. This novel method involves placing the urn on a substantially horizontal platform suspended by a frame of an apparatus, operating a lowering mechanism mounted to the frame of the apparatus to lower the platform and the urn from a top position to a bottom position, and automatically releasing the platform when the platform is in the bottom position. Once the platform has been disconnected or decoupled from the lowering mechanism, this lowering mechanism can be raised back to its upper (starting) position. The platform and urn remain in the ground, i.e. at the bottom position for being subsequently interred.

The embodiments of the invention described above are intended to be exemplary only. As will be appreciated by those of ordinary skill in the art, to whom this specification is addressed, many obvious variations can be made to the embodiments present herein without departing from the spirit and scope of the invention. The scope of the exclusive right sought by the applicant is therefore intended to be limited solely by the appended claims.

The invention claimed is:

1. An apparatus for lowering an urn, the apparatus comprising:

a frame;

a substantially horizontal platform for supporting the urn, the platform having a plurality of substantially vertical holes extending from a top surface of the platform to a bottom surface of the platform; and a lowering mechanism mounted to the frame and releasably connected to the platform for lowering the platform and the urn from a top position to a bottom position and for automatically releasing the platform when the platform is in the bottom position, wherein the lowering mechanism comprises four hangers releasably connecting the platform to respective suspension straps through the substantially vertical holes in the platform such that the hangers, after reaching the bottom position, are withdrawn upwardly through the holes in the platform to thereby release the platform.

2. The apparatus as claimed in claim 1 wherein said substantially vertical holes are each shaped as a square and wherein each hanger comprises a square body for insertion through a corresponding square hole in the platform, each hanger further comprising a pivoting arm that is pivoted into a substantially horizontal posture to support the platform from underneath, the pivoting arm of the hanger comprising a counterweight to cause the pivoting arm to return to a substantially vertical posture when legs underneath the platform reach the bottom position, thus removing the weight of the platform from the pivoting arm of the hanger to thereby enable rotation of the hanger into the substantially vertical posture that permits the platform to be automatically released by pulling the hangers upwardly through the respective holes in the platform.

3. The apparatus as claimed in claim 2 wherein the lowering mechanism comprises a reel driven by an electric motor for reeling the suspension straps around each respective reel to thereby lower the platform.

4. The apparatus as claimed in claim 3 wherein the lowering mechanism comprises a locking mechanism which is set for a desired depth corresponding to the bottom position so that the locking mechanism releases the platform when the platform reaches the bottom position and furthermore causes the reel to rotate in an opposite direction to lift the hangers through the respective holes of the platform.

5. The apparatus as claimed in claim 4 wherein the lowering mechanism comprises a tension releaser mounted to the frame for releasing tension on one or more of the suspension straps.

6. The apparatus as claimed in claim 1 wherein the frame comprises a plurality of skirt rods for holding a skirt that conceals mechanisms internal to the apparatus.

7. The apparatus as claimed in claim 1 wherein the frame comprises liquid-bubble levellers embedded within horizontal members of the frame for levelling the frame.

8. The apparatus as claimed in claim 1 wherein the frame comprises four substantially upright legs, each substantially upright leg having a hydraulic cylinder for vertically displacing an upper leg relative to a lower leg.

9. The apparatus as claimed in claim 8 wherein the frame comprises a pair of cable-actuated frame-collapsing mechanisms, wherein each mechanism has a pull rod actuating a cable that disengages a trigger pin from a hole in the substantially upright leg.

10. A disposable platform for use with an apparatus for lowering an urn, the platform comprising:

a substantially horizontal H-shaped configuration for supporting the urn;

four square holes for receiving respective hangers, the holes being disposed in corner extensions of the platform, each pair of corner extensions defining a rectangular cut-out region to enable the platform and the urn to be displaced vertically without interfering with the apparatus; and a pair of legs having a depth greater than a pivoting arm of the hanger.

11. A method of lowering a cinerary urn, the method comprising:

releasably connecting hangers to the platform, the hangers being also connected to respective suspension straps for lowering the platform and the urn, the platform having a plurality of substantially vertical holes extending from a top surface of the platform to a bottom surface of the platform;

placing the urn on a substantially horizontal platform suspended by a frame of an apparatus;

operating a lowering mechanism mounted to the frame of the apparatus to lower the platform and the urn from a top position to a bottom position; and automatically releasing the platform when the platform is in the bottom position by withdrawing the hangers upwardly through the substantially vertical holes in the platform to thereby release the hangers from the platform.

* * * * *